United States Patent [19]

McHugh

[11] 4,355,822

[45] Oct. 26, 1982

[54] PROTECTIVE BOOK COVER

[76] Inventor: Edward L. McHugh, 1406 Clive Cir., Wilmington, Del. 19803

[21] Appl. No.: 179,435

[22] Filed: Aug. 19, 1980

[51] Int. Cl.[3] ..... B42D 3/04

[52] U.S. Cl. ..... 281/34; 281/19 R; 281/31

[58] Field of Search ..... 281/34, 31, 32, 29, 281/35, 36, 37, 19 R, 17; 229/1.5 R

[56] References Cited

U.S. PATENT DOCUMENTS

| | | | |
|---|---|---|---|
| 2,901,103 | 8/1959 | Brunner | 206/80 |
| 3,009,715 | 11/1961 | Brody | 281/34 |
| 3,165,337 | 1/1965 | Leibowitz | 281/34 |
| 3,572,767 | 3/1971 | Learned | 281/34 |
| 3,981,522 | 9/1976 | Bloom | 281/34 |
| 4,128,262 | 12/1978 | DuCorday | 281/34 |
| 4,209,187 | 6/1980 | Forrest | 281/19 |
| 4,280,241 | 7/1981 | Pfaff | 281/35 X |

*Primary Examiner*—Paul A. Bell
*Assistant Examiner*—John S. Brown
*Attorney, Agent, or Firm*—Connolly and Hutz

[57] ABSTRACT

A protective book cover includes a pair of pocket sections for removably receiving the front and back covers of a book with the open ends of the pocket sections disposed toward but spaced from each other by a distance less than the width of each pocket and with the pocket sections connected together by a spline joined to the outer members of the pocket sections.

10 Claims, 6 Drawing Figures

PROTECTIVE BOOK COVER

BACKGROUND OF INVENTION

Paperback books in current use are generally of two types. One type is works of fiction and non-fiction which are read over a period of time for reading enjoyment. The other type is more of a reference variety such as textbooks or directories which are periodically referred to over substantially long periods of time and may be frequently used. It is desirable to provide a removable book cover for such paperback books particularly to protect the book while in use or while being stored. Book covers are also desirable under certain circumstances when the reader does not want others to be aware of his specific material. Prior art attempts for providing suitable removable book covers have not be totally satisfactory. One major problem is that while reading, the cover tends to slip off the book. Usually the reader must use two hands for holding the book open for reading. Similar objections are found for book covers used in other types of books such as textbooks, telephone directories, etc.

U.S. Pat. Nos. 4,209,187 and 2,901,103 represent exemplary prior art book covers.

SUMMARY OF INVENTION

An object of this invention is to provide a removable protective book cover which will be used on paperback books, textbooks, directories and the like including hardback books.

A further object of this invention is to provide a book cover which remains securely on the book even during use and yet which may be conveniently removed therefrom so as to be useable on a different book.

A still further object of this invention is to provide a book cover which may be conveniently manufactured at relatively small cost.

A yet further object of this invention is to provide a book cover which is effective on books of various thicknesses.

In accordance with this invention, a removable protective book cover includes a pair of pocket sections telescopically receiving the front and back covers of a book. The outer members of each pocket section are connected to each other by a spline. The open sides of the pocket sections are disposed toward each other spaced apart by a distance less than the width of each pocket section. In this manner the pocket sections may be located generally adjacent to the inner edges of the front and back covers.

In a preferred embodiment of this invention the pocket sections are separate members and the spline is a flap integrally extending from the outer member of one pocket section. The book cover may accommodate different book thicknesses in accordance with the location the other pocket section is connected to the flap. Such connection is preferably by means of a reuseable adhesive.

Various ramifications are possible in practicing the invention such as providing a bookmark strip integral with one of the pocket sections. The front pocket section may be opaque while the back pocket section may be transparent, translucent or opaque.

THE DRAWINGS

DETAILED DESCRIPTION

Figure 1:
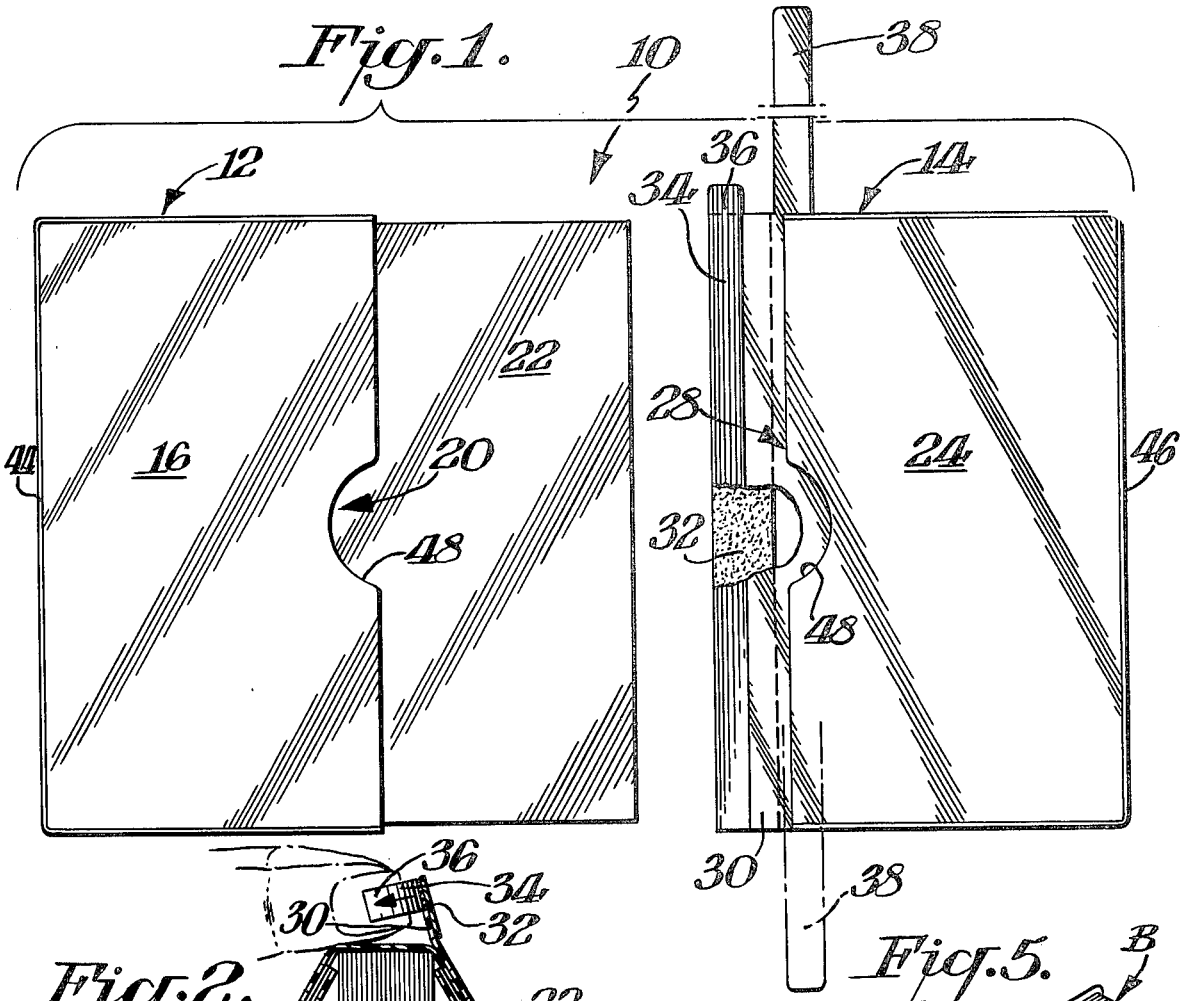
FIG. 1 is a plan view of a book cover in accordance with this invention before the individual members are secured together.

FIG. 1 shows a book cover 10 in accordance with this invention. As indicated therein, the book cover 10 includes a pair of pocket sections 12, 14 adapted to telescopically receive the front and back covers of a book. It is to be understood that the thickness of the various elements in cover 10 has been exaggerated in the drawings for a better understanding of the invention. Pocket section 12 which may be, for example, receiving the front book cover includes an inner member 16 and an outer member 18 (FIGS. 2–3) which are secured together along three of their edges in any suitable fashion leaving the fourth side or edge 20 open so as to form the pocket. Outer member 18 has a flap 22 integrally extending therefrom.

Pocket section 14 similarly has an inner member 24 and an outer member 26 secured thereto along three sides thereof with the fourth side or edge 28 likewise open to form the pocket section. A narrow flap 30 also extends from pocket section 14. An adhesive strip 32 is secured to the outer portion of flap 30 but extends outwardly beyond flap 30 so that its adhesive inner surface may be exposed. The exposed portion of the adhesive inner surface of strip 32 is covered by a removable sheet 34 which extends beyond the periphery of pocket section 14 so as to provide a convenient pull tab 36 for purposes later described. Pocket section 14 also includes an integral extension 38 extending outwardly from outer member 26.

Figure 2:
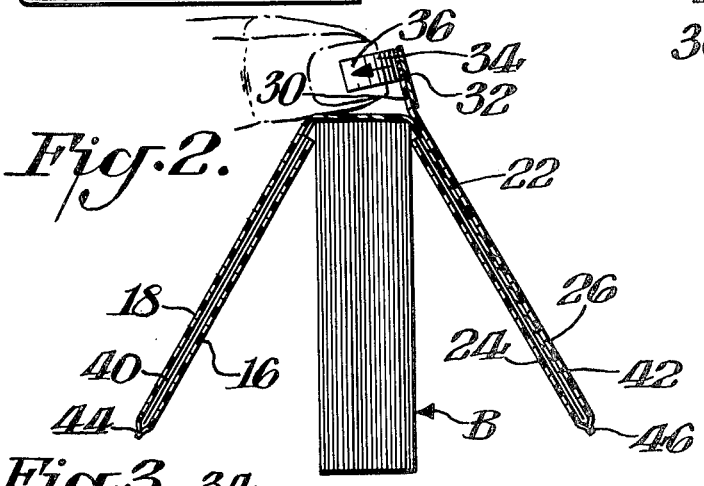
FIG. 2 is a cross-sectional view in elevation showing the book cover of FIG. 1 while being mounted on a book.
Figure 3:
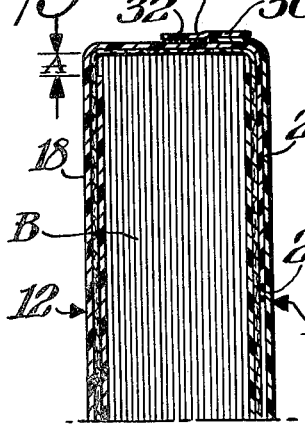
FIG. 3 is a cross-sectional view in elevation showing the book cover of FIGS. 1–2 mounted on a book.
Figure 4:
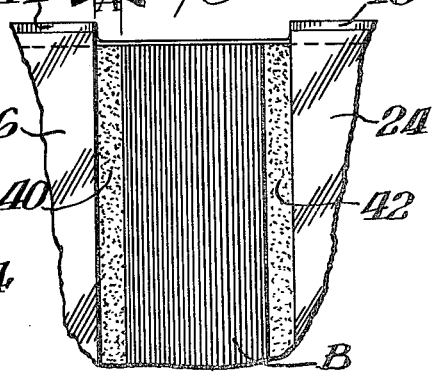
FIG. 4 is a fragmental plan view of the book cover of FIGS. 1–3 mounted on a book.

FIGS. 2–5 illustrate cover 10 removably secured on a book B. To mount the cover on a book, front cover 40 of book B may be telescoped into first section 12 with the flap 22 freely extending therefrom. As best shown in FIGS. 2 and 4, front section 12 is dimensioned so as to extend substantially adjacent to the binding of book B or inner edge of cover 40. Back cover 42 may then be inserted into section 14. Obviously the sequence of inserting the front and back covers is not critical.

Flap 22 is preferably of a length slightly smaller than the length of each pocket section. Accordingly after each pocket section is mounted on a respective book cover, flap 30 may be bent away from the book binding, and flap 22 may be slid into pocket section 14 between back cover 42 and outer member 26. Alternatively, after pocket section 12 is mounted on front cover 40, flap 22 may be pressed against the outer side of back cover 42, and flap 22 and back cover 42 may, as a unit, be telescoped into pocket section 14.

FIG. 2 illustrates the position of the various components of cover 10 immediately before they are secured together. In this respect, the inner member of each pocket section is located adjacent to the binding of book B. The portion of flap 22 which is exposed from pocket 14 covers the binding and thus acts as a spline. Flap 30 is bent outwardly away from the spline, and in this condition, protective sheet 34 is peeled from adhesive strip 32 by grasping tab 36 and pulling outwardly to expose the adhesive on strip 32 which extends beyond flap 30. The exposed portion of strip 32 is then pressed against flap 22 for securing the pocket sections 12 and 14 together.

Figure 5:
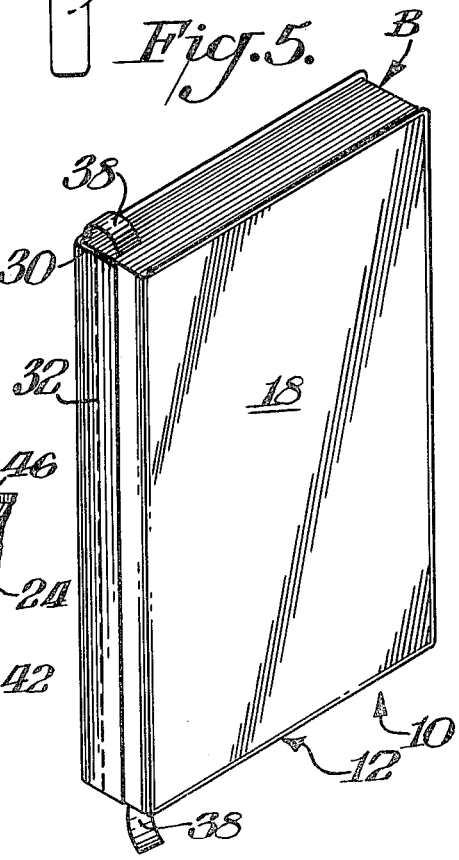
FIG. 5 is a perspective view of the book cover of FIGS. 1–4 mounted on a book.

During use of the book, extension 38 may function as a bookmark by being bent downward and extends completely down and beyond the book length (FIG. 5). Other ramifications of this invention are also possible. For example, means may be provided such as loops or the like to which pens, pencils or other instruments may be removably secured particularly when book cover 10 is used as a protective cover for a reference book. Decorations or advertisements may also be applied to book cover 10.

An important feature of this invention is that the spacing between the open edges 20 and 28 of the pocket sections 12 and 14 when the pocket sections are secured together is less than the width of each of the inner members 16, 24. This assures that the inner members 16, 24 will be disposed close to the binding of the book B. Accordingly when the book is opened during use, the pocket sections will remain in place on their respective covers and not tend to slip off which is a fault characteristic of the prior art. Additionally the pocket sections tend to hold the book covers in an open or spread condition so that a reader can hold the book in only one hand while reading.

Book cover 10 may be made of various materials and preferably a heat sealable material such as vinyl is used so that the edges connecting the three closed sides of each pocket section may be conveniently secured together. During manufacture, however, the outer edge 44 of pocket section 12 and the outer edge 46 of pocket section 14 may be formed by having inner members 16, 24 extending from their respective outer members and then folding the inner members to thereby create their respective edges 44, 46. The pocket sections 12, 14 may likewise be transparent, translucent or opaque and may be of different colors or tints. It is also possible to practice this invention by having the pocket sections of differing colors, tints or degrees of transparency. There are occasions, for example, where a user may wish to keep private from onlookers the type of book the user is reading. In such case, an opaque pocket section particularly for the front cover would be preferable.

As previously indicated in the preferred practice of this invention, the inner member 16, 24 of each pocket section is located adjacent the binding of the book. There should, however, be a slight gap from the binding to avoid the inner member digging in and damaging the binding. FIGS. 3 and 4 illustrate this gap A.

Figure 6:
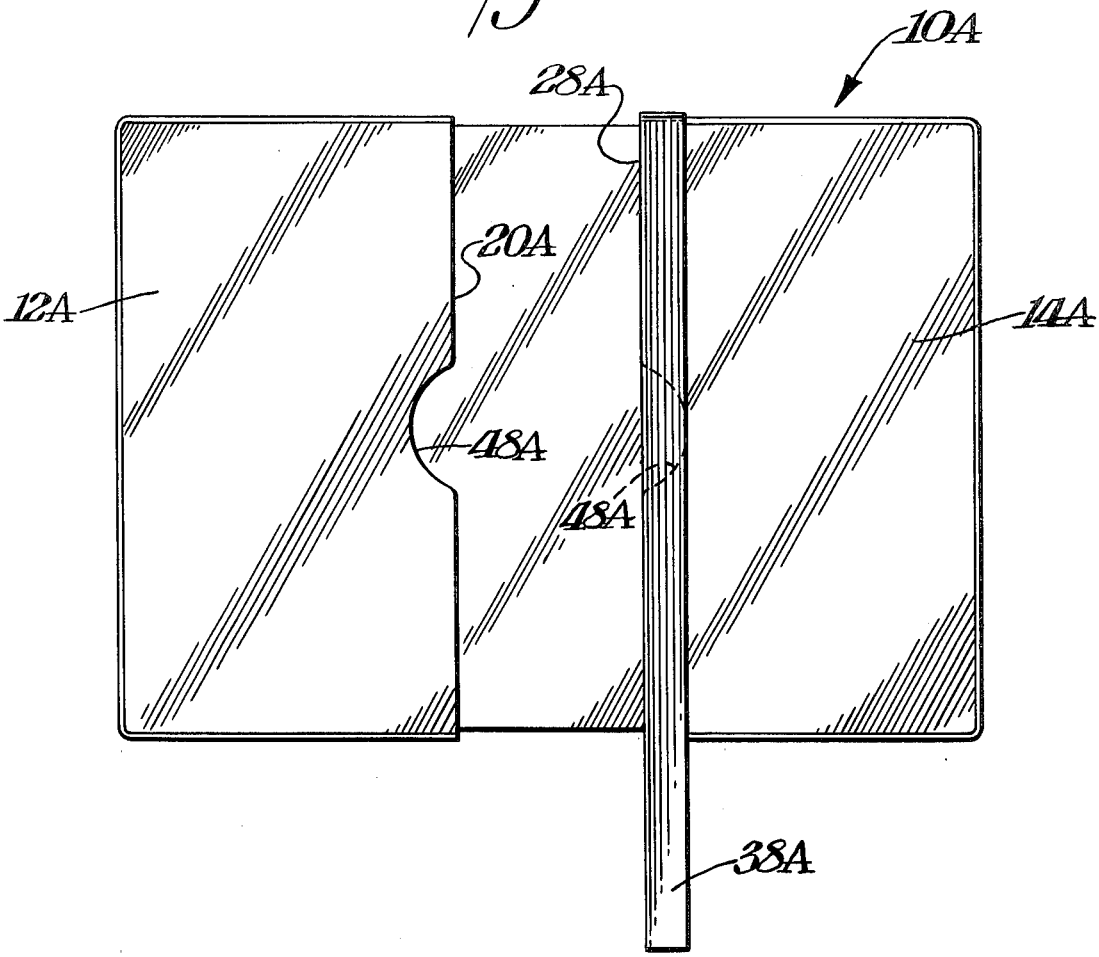
FIG. 6 is a plan view of a modified form of book cover.

FIG. 6 is a plan view of an alternative form of this invention wherein the cover 10A includes its pocket sections 12A and 14A integrally attached. This embodiment has the advantage of simplicity in manufacture but loses the advantage of adaptability of customizing for various book thicknesses. In FIG. 6, like reference numerals are used for like parts, thus a bookmark 38A is provided adjacent the inner edge 28A of back pocket section 14A. Each front edge 20A, 28A includes a cut out 48A which is useful in facilitating the insertion of the book cover into the respective pocket section. The embodiment of FIGS. 1–5 may likewise include cut outs 48, although in that embodiment, such cut outs are not as necessary.

The illustrated embodiments are particularly designed for conventional paperback books which are generally $4\frac{1}{4}$ inches by 7 inches. In the embodiment of FIG. 6, the gap or spacing of the spline section would be about 2 inches. With the embodiment of FIGS. 1–5, however, the spline would, of course, correspond to the thickness of the book. Gap A is preferably 1/16 inch$\pm$1/32 inch. The long edge of each pocket section is preferably $7\frac{1}{8}$ to $7\frac{1}{4}$ inches while the overall width (FIG. 6) of the book cover is $10\frac{1}{4}$ inches with each pocket section being 4 to 4 1/16 inches thus leaving a gap or spline of $2\frac{1}{8}$ to $2\frac{1}{4}$ inches. Bookmark 38, 38A is $\frac{1}{2}$ inch wide and $9\frac{3}{4}$ to 10 inches long which also represents a departure from the prior art where such bookmarkers are generally 9 inches or less. These dimensions would be effective on all such standard sized paperback books of substantially all thicknesses. The invention is not limited to use of paperback books. Thus by appropriate dimensioning, the invention may also be practiced with hardback books, telephone directories and the like.

As previously indicated, any suitable materials may be used for the components of the book cover. Similarly any suitable adhesive for strip 32 may be used. In the preferred practice of the invention, however, a conventional reuseable adhesive is used so that the same book cover may be reused for various books, and where the books have different thicknesses, adhesive strip 32 may be secured to different locations on flap 22.

The protective book cover of this invention thus provides a removable cover which may accommodate books of varying thicknesses while still maintaining an effective cover which will not tend to slip off the book and will facilitate the user reading the book.

What is claimed is:

1. A removable protective book cover in combination therewith, a book having a front cover and a back cover with the pages therebetween being connected to a binding to which said front and back covers are connected, said removable protective cover comprising a first pocket section and a second pocket section detachably connected to each other for telescopically receiving a respective one of said book covers therein, each of said pocket sections having an inner member and an outer member with their edges connected together along three sides thereof and having its fourth side completely open, each outer member extending outwardly beyond its open side to form a flap, each of said pocket sections being mounted over its respective book cover with its said inner member juxtaposed said binding of said book, one of said flaps being tucked into the other of said pocket sections between the outer member of said other pocket section and its book cover, and adjustable attaching means on the other of said flaps securing said pocket sections together.

2. The combination of claim 1 wherein said one flap is of a length less than the length of the other pocket section.

3. A removable protective book cover comprising a first pocket section and a second pocket section for receiving a respective cover of a book, each of said pocket sections having an inner member and an outer member with their edges connected along three sides thereof and having its fourth side completely open, each outer member extending outwardly beyond its open side to form a flap, said flap on said first pocket section being of a length less than the length of said second pocket section whereby said flap of said first pocket section may be inserted in a flat condition into said second pocket section to permit said pocket sections to be disposed near each other for closely fitting on the respective covers of a book with said inner members of said pocket sections located near the binding of the book, and adjustable attaching means on said flap of said second pocket section for attachment to said outer member of said first pocket section after said pocket sections are mounted on the book.

4. The cover of claim 3 wherein the distance between said open ends of said pocket sections is less than the width of said pocket sections when said pocket sections are secured together.

5. The cover of claim 3 wherein the length of said flap on said second pocket section is the same as the length of said first pocket section.

6. The cover of claim 3 wherein said adjustable attaching means includes an adhesive strip mounted to said flap of said second pocket section with a portion of said adhesive strip extending laterally therebeyond and to be exposed therefrom, and a reuseable adhesive being on the exposed portion of said adhesive strip.

7. The cover of claim 6 including a removable protective sheet on said exposed portion of said adhesive strip.

8. The cover of claim 3 including a bookmark integrally secured to said second pocket section, and said bookmark being greater than 9 inches long.

9. The cover of claim 3 wherein at least one of said pocket sections is opaque.

10. The cover of claim 9 wherein both of said pocket sections are opaque.

* * * * *